US009445662B2

(12) United States Patent
Hoff

(10) Patent No.: US 9,445,662 B2
(45) Date of Patent: Sep. 20, 2016

(54) LEG ASSEMBLY

(71) Applicant: Floyd Design LLC, Detroit, MI (US)

(72) Inventor: Kyle Hoff, Girard, OH (US)

(73) Assignee: FLOYD DESIGN LLC, Detroit, MI (US)

( * ) Notice: Subject to any disclaimer, the term of this patent is extended or adjusted under 35 U.S.C. 154(b) by 0 days.

(21) Appl. No.: 14/591,892

(22) Filed: Jan. 7, 2015

(65) Prior Publication Data

US 2016/0192771 A1 Jul. 7, 2016

(51) Int. Cl.
*F16M 11/24* (2006.01)
*A47B 3/06* (2006.01)

(52) U.S. Cl.
CPC ..... *A47B 3/06* (2013.01)

(58) Field of Classification Search
CPC combination set(s) only.
See application file for complete search history.

(56) References Cited

U.S. PATENT DOCUMENTS 164,386 A * 6/1875 Merrick ..... 248/164
1,181,712 A * 5/1916 Wittliff ..... 5/306
1,684,727 A * 9/1928 Cerny ..... A47C 7/002 248/188.91
1,706,431 A * 3/1929 Wittliff ..... A47C 19/021 403/43
1,730,442 A * 10/1929 Wittliff ..... A47C 19/021 5/306
1,732,872 A * 10/1929 Wittliff ..... A47C 7/002 248/440
1,820,103 A * 8/1931 Toy ..... 248/163.1
1,820,589 A * 8/1931 Wittliff ..... 5/306
1,885,664 A * 11/1932 Wittliff ..... F16B 12/18 248/188.91
2,618,523 A * 11/1952 Boyce ..... A47B 3/0812 108/130
2,873,035 A * 2/1959 Unis ..... 108/186
2,936,078 A * 5/1960 Ziegler ..... 108/59
3,215,382 A * 11/1965 Stein ..... 248/172
4,333,638 A * 6/1982 Gillotti ..... 5/613
4,354,437 A * 10/1982 Logan ..... 108/128
4,728,066 A * 3/1988 Lang et al. ..... 248/165
4,974,525 A * 12/1990 Sheffield ..... 108/118
5,127,647 A * 7/1992 Wilkinson ..... 482/52
5,325,793 A * 7/1994 Martin ..... 108/130
5,466,205 A * 11/1995 McLane et al. ..... 482/140
5,496,094 A * 3/1996 Schwartzkopf et al. ..... 297/45
5,657,703 A * 8/1997 Johnson ..... 108/118
6,098,944 A 8/2000 Pangborn et al.
6,182,578 B1 * 2/2001 Fanuzzi ..... 108/36
6,349,906 B1 * 2/2002 Anderson ..... 248/146
6,419,201 B1 * 7/2002 Hughes et al. ..... 248/514
6,591,778 B1 * 7/2003 Alderman ..... 119/28.5
6,705,234 B1 * 3/2004 Miller et al. ..... 108/36
6,817,445 B2 * 11/2004 Slemmer ..... 182/154
7,168,666 B2 * 1/2007 Tucker ..... 248/150
7,431,257 B1 * 10/2008 Davis et al. ..... 248/431
7,883,143 B2 * 2/2011 Reynolds ..... 297/45
8,074,584 B2 * 12/2011 Collins ..... 108/156
2004/0232740 A1 * 11/2004 Enge ..... 297/16.2

(Continued)

OTHER PUBLICATIONS

Yanko Design: Form Beyond Function: Table on Tight Oct. 18, 2010 (2 pgs).

(Continued)

*Primary Examiner* — Monica Millner
(74) *Attorney, Agent, or Firm* — Foley & Lardner LLP

(57) ABSTRACT

A leg assembly includes four legs, each of the legs configured to couple to an outer edge of a generally planar member to form an assembly that has a surface supported by the four legs. The leg assembly also includes an adjustable strap coupled to and extending between two of the four legs to form a bracing structure to provide enhanced structural rigidity for the assembly for attachment to a planar element includes four legs.

20 Claims, 4 Drawing Sheets

(56) References Cited

U.S. PATENT DOCUMENTS

| | | | | |
|---|---|---|---|---|
| 2005/0046133 | A1* | 3/2005 | Braucke et al. | 280/47.35 |
| 2005/0155530 | A1* | 7/2005 | Goldberg | 108/118 |
| 2005/0199162 | A1* | 9/2005 | Hendricks et al. | 108/118 |
| 2012/0181823 | A1* | 7/2012 | Brunner | 297/188.01 |
| 2012/0304390 | A1* | 12/2012 | Perez | 5/658 |
| 2013/0234383 | A1* | 9/2013 | Eastwood | 269/309 |
| 2014/0167482 | A1* | 6/2014 | Myre et al. | 297/463.1 |
| 2015/0021970 | A1* | 1/2015 | Revta et al. | 297/452.1 |

OTHER PUBLICATIONS

Gizmodo: The Only Tools You Need to Build This Bed Are Ratchet Straps Mar. 10, 2012 (2 pgs).

Hillary Fairfield Design: Modern Table Leg Stylized Clamps (1 pg).

* cited by examiner

LEG ASSEMBLY

BACKGROUND

The present application relates generally to the field of leg assemblies for tables, benches, and other products that include a generally horizontal surface (e.g., member, element) to which legs may be coupled. The present application also relates to the field of shelves.

Items such as tables, benches, chairs, platforms, stages, and the like may include a generally horizontal planar surface or member (e.g., a tabletop) that is supported by one or more generally vertical legs. For example, according to one known construction, a table may include a rectangular tabletop supported by four legs positioned at or near each corner of the tabletop. The legs may be coupled to the tabletop in a variety of ways. For example, legs may include features (e.g., tenons, tongues, rabbets, etc.) that are intended to interact with corresponding features of the planar member (e.g., mortises, grooves, rabbets, etc.). These features generally require a high level of skill, and/or precise woodworking equipment to manufacture or machine. In other furniture designs, legs may be coupled to furniture via various fasteners (e.g., biscuits, dowels, screws, bolts, nuts, etc.).

In many configurations, the legs are produced so as to be coupled to one specific planar member. For example, in the case of a table, the legs may have a substantially identical aesthetic finish as the tabletop (e.g., the same wood stain, aesthetic look and feel, etc.), and the coupling members responsible for coupling the legs to the tabletop may be specifically configured for complementary features provided with the tabletop. Coupling members such as bolts and screws may be used to rigidly secure the legs to the tabletop, and may require tools to tighten the relevant components to ensure a relatively secure fit.

It would be advantageous to provide a leg assembly that may be configured for attachment to any of a variety of different types of planar members in interchangeable fashion to allow a user to create custom tables, benches, chairs, platforms, and the like. It would also be advantageous to provide legs that may be relatively easily attached and detached from the planar member so as to allow for relatively simple assembly and disassembly. These and other advantageous features will be apparent to those reviewing the present disclosure.

SUMMARY

According to an exemplary embodiment, a leg assembly includes four legs, each of the legs configured to couple to an outer edge of a generally planar member to form an assembly that has a surface supported by the four legs. The leg assembly also includes an adjustable strap coupled to and extending between two of the four legs to form a bracing structure to provide enhanced structural rigidity for the assembly.

According to another exemplary embodiment, a table includes a tabletop, four legs coupled to the tabletop, each of the four legs including a clamping device for coupling the leg to an edge of the tabletop, and at least one adjustable strap extending between and coupling a plurality of legs to each other to resist outward movement of the legs relative to the tabletop to provide enhanced structural rigidity for the table.

According to yet another exemplary embodiment, a method of coupling a plurality of legs to a tabletop includes positioning a first leg against a first corner of the tabletop, positioning a second leg against a second corner of the tabletop, the second corner being diagonal to the first corner, and bracing the first and second legs to the first and second corners, respectively, using a first adjustable member extending between the first and second legs.

DETAILED DESCRIPTION

The present application relates to a leg assembly 11 that is configured to couple to a generally flat or planar material (e.g., rectangular wooden boards, reclaimed doors or other components, or any of a variety of other planar materials that may be made from a wide variety of different types of materials). As used herein, the terms "generally flat" and "generally planar" should be understood to include components that are not perfectly flat or planar, but instead may have features or configurations that protrude from or extend into the surface of the component. By way of example, a six-panel door would be considered to be generally flat or planar despite the fact that the borders of the panels of the door may extend below the surface of the door. Accordingly, it should be understood that "generally flat" and "generally planar" as discussed herein to refer to the structural member to which the legs are attached should be interpreted as any relatively flat member that could conceivably be used as a tabletop, work surface, seat, or other member to which legs may be attached.

Figure 1:
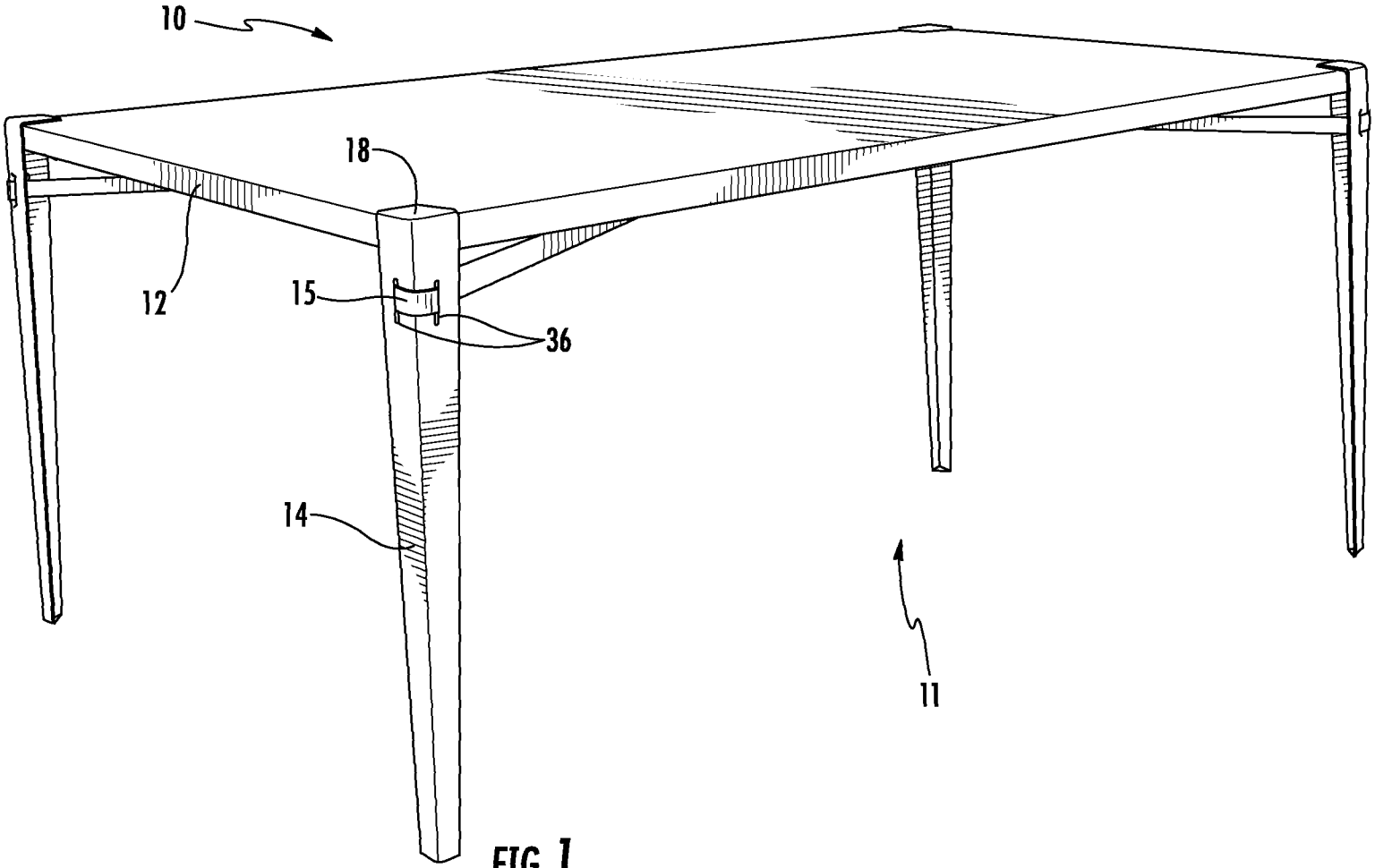
FIG. 1 illustrates a perspective view of a table according to an exemplary embodiment.
Figure 4:
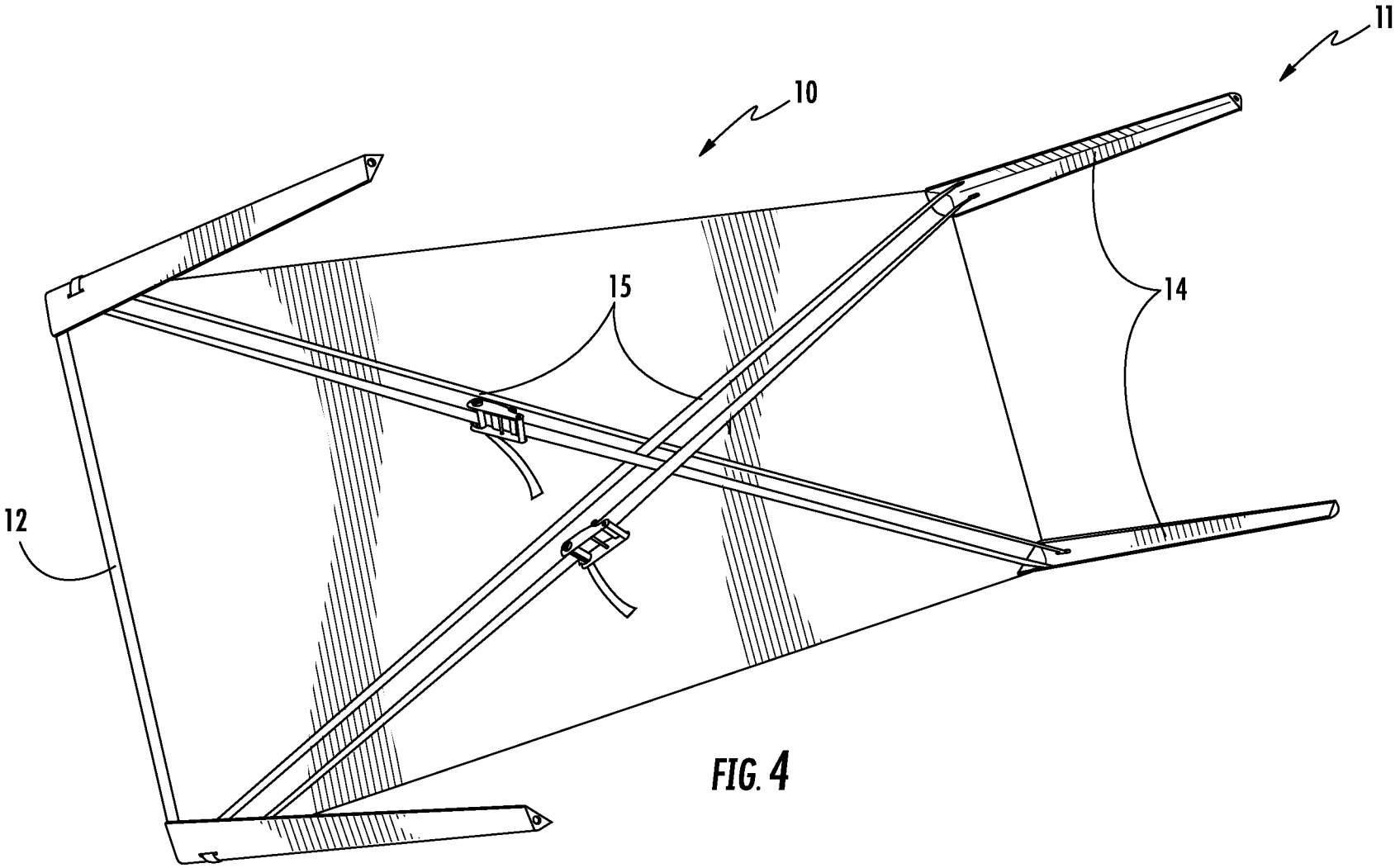
FIG. 4 illustrates a bottom perspective view of the table shown in FIG. 1.

As shown in FIGS. 1 and 4, the leg assembly 11 may be coupled to a generally flat and rectangular piece of material in order to form a piece of furniture, such as a table, bench, chair, desk, cabinet, etc. According to another exemplary embodiment, the leg assembly 11 may also be coupled to a generally rectangular frame. For example, the leg assembly 11 may be coupled to a bedframe, a rectangular frame having an inset (e.g., a glass inset), or any other suitable frame. According to still other exemplary embodiments, the leg assembly 11 may be used in other fields. For example, the leg assembly 11 may be used to form platforms, scaffolding, canopies, or other devices that may advantageously utilize a plurality of legs coupled thereto.

Referring to FIGS. 1 and 4, an exemplary embodiment for a table 10 that includes the leg assembly 11 is shown. The table 10 includes a generally flat rectangular member or element shown as tabletop 12, and the leg assembly 11 includes four legs 14 that support the tabletop 12 at each of its four corners, and ratchet straps 15 (see, e.g., FIG. 4) that extend between each diagonal pair of legs 14. The ratchet straps 15 are coupled only to the legs and do not touch or otherwise engage the tabletop 12. The tabletop 12 may be formed from wood, metal, plastic, composite, or any other suitable material. Although the tabletop 12 is shown with a particular length, width, and thickness, other elements or frames can be used with the leg assembly 11 and may have any suitable length, width, and thickness. Further, although the leg assembly 11 is shown in FIGS. 1 and 4 to form a table 10, it should be understood that similar leg assemblies may be used with other planar or rectangular elements to make other types of furniture and devices, according to other exemplary embodiments. Further, although the leg assembly 11 is shown as coupled to a rectangular tabletop, the leg assembly 11 may also be configured to be coupled to planar elements having other shapes (e.g., oval, round, polygonal, etc.).

Figure 2:
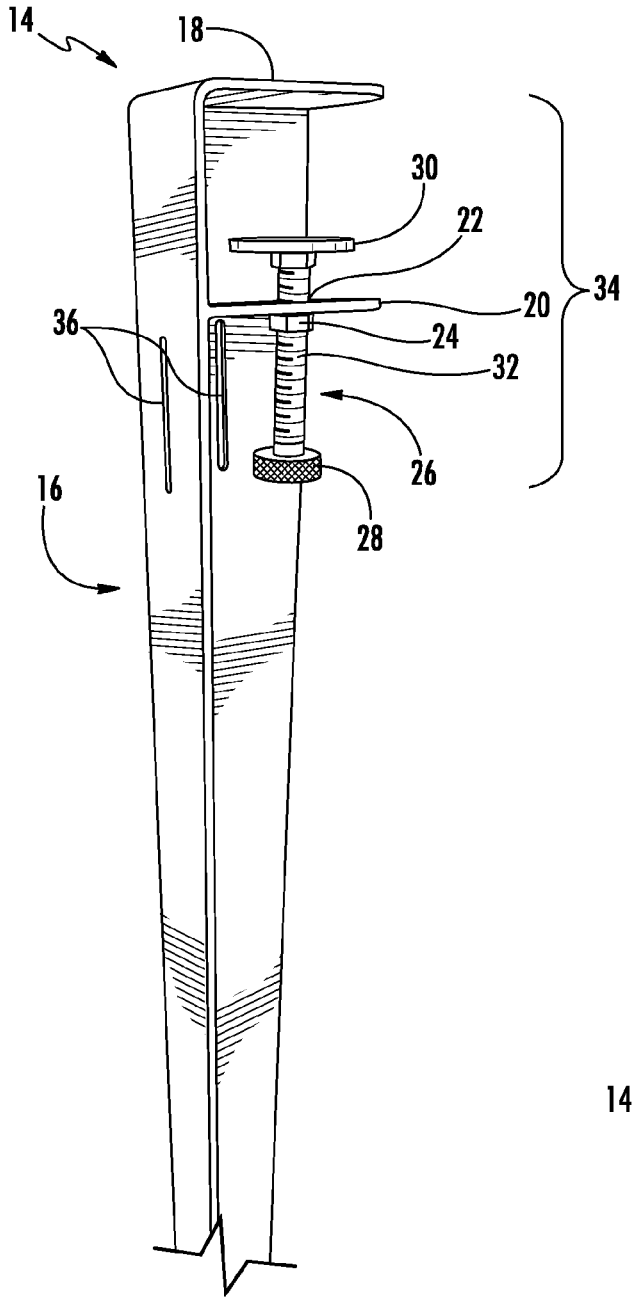
FIG. 2 illustrates a rear perspective view of a leg coupled to the table shown in FIG. 1 according to an exemplary embodiment.
Figure 3:
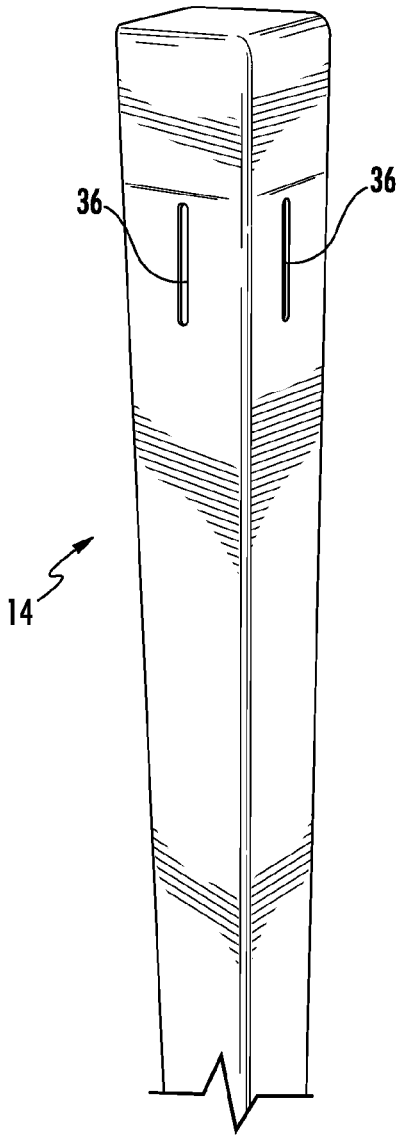
FIG. 3 illustrates a front perspective view of the leg shown in FIG. 2.

The leg 14 shown in FIGS. 2-3 includes a body portion 16 having a "L"-shaped cross-section (e.g., similar to angle iron). Thus, the cross-section of the body portion 16 is configured to engage (e.g., abut, bound, etc.) perpendicular vertical surfaces which comprise a corner of a planar rectangular element, such as the tabletop 12. According to other exemplary embodiments, the legs 14 may include a body portion 16 having a rounded "C"-shaped cross-section, in order to engage a rounded edge of a planar element. According to still other exemplary embodiments, the legs 14 may include a body portion 16 having a cross-section defined by two or more sides that configured to engage a polygonal (e.g., hexagonal, octagonal, etc.) planar element. Stated another way, the legs may be configured to engage portions of surfaces having a variety of configurations according to various exemplary embodiments.

As shown in FIG. 2, the body portion 16 of each leg 14 is bounded on a top side by an upper plate 18 (e.g., an upper support, a top wall, roof, etc.). When a corner of the tabletop 12 and the body portion 16 are engaged, the upper plate 18 engages a top surface of the tabletop 12. The body portion 16 of each leg 14 further includes a lower plate 20 (e.g., a lower support, lower wall, base support, etc.) below the upper plate 18. The lower plate 20 and the upper plate 18 are substantially coplanar, and may be spaced apart from each other by any suitable distance. For example, according to an exemplary embodiment, the lower plate 20 and the upper plate 18 are spaced apart by approximately two inches, although they may be spaced apart by a lesser or greater distance according to other exemplary embodiments. The upper plate 18 and the lower plate 20 may be coupled to the body portion 16 in any suitable manner. For example, the lower plate 20 may be welded to perpendicular inner surfaces of the body portion 16. Although not shown in the FIGURES, one or more braces or ribs may be coupled to a bottom surface of the lower plate 20 for reinforcement.

According to an exemplary embodiment, the upper plate 18 may initially be an extension of one side of the body portion 16, which is bent downward 90° and welded to the other of the two sides of the body portion 16. According to another exemplary embodiment, the upper plate 18 may be formed via a stamping process. According to another exemplary embodiment, the upper plate 18 may be welded to both sides of the top end of the body portion 16. Accordingly, the top plate may be integrally formed with or formed separately and coupled to the leg. The leg may be made of any suitable material (e.g., metal such as steel, aluminum, etc., a polymeric material such as injection molded plastic, etc., wood, a composite material, or any other material suitable for use as a leg such as that described herein). Any suitable coupling method of the upper and lower plates may be utilized according to various other exemplary embodiments.

According to an exemplary embodiment, a hole 22 is disposed within the lower plate 20, and a threaded nut 24 is coupled to a bottom surface of the lower plate 20. The hole may be generally centrally disposed within the lower support or may be positioned elsewhere in the support. The threaded nut 24 is concentric with the hole 22. According to another exemplary embodiment, a threaded hole is disposed within the lower plate 20. According to other exemplary embodiments, the nut may be a hex nut, a pem nut, or any other type of threaded aperture that may be useful in the context described herein.

According to an exemplary embodiment, a thumbscrew 26 is threadably coupled to the nut 24 (or to the threaded hole, as the case may be). The thumbscrew 26 comprises a knob 28 provided on a bottom end thereof, a flat member or element 30 (e.g., a foot, disc, platform, etc.) provided on a top end thereof, and a threaded rod 32 provided between the knob 28 and the flat member 30. As shown in FIG. 2, the thumbscrew 26 is threadably coupled to the nut 24 such that the knob 28 is positioned below the lower plate 20 and the flat member 30 is positioned within the space between the lower plate 20 and the upper plate 18. Further, the flat member 30 may be rotatable relative to the rod 32. Thus, the rod 32 is simultaneously rotatable relative to the nut 24 and the flat member 30. According to other exemplary embodiments, the flat member 30 may be rotatably fixed relative to the rod 32.

The knob 28 may be rotatably fixed relative to the rod 32. Thus, the thumbscrew 26 may be threadably tightened or loosened by rotating the knob 28. As shown, the knob 28 may be knurled so that a user may better grasp it. According to other exemplary embodiments, a knob may be configured in other ways to enable a user to better grasp it. For example, a knob may have a polygonal cross-section or a special coating (e.g., a rubberized coating). Also, the circumference of the knob 28 may be greater than that of the rod 32 so that a user can deliver greater torque to the rod 32. According to other exemplary embodiments, any suitable handle (e.g., a "T" handle) may be coupled to the bottom end of the rod 32.

Together, the thumbscrew 26, the lower plate 20, the upper plate 18, and the section of the body portion 16 between the lower plate 20 and the upper plate 18 form a clamp 34 (e.g., a clamping device or structure). The clamp 34 may be used to secure the leg 14 to the tabletop 12 or any other suitable planar material. For example, a corner of the tabletop 12 may be positioned between the upper plate 18 and the flat member 30 such that the tabletop 12 engages the perpendicular vertical surfaces of the body portion 16. Next, the thumbscrew 26 may be tightened until the flat member 30 engages a bottom surface of the tabletop 12. Thus, when the flat member 30 engages the bottom surface of the tabletop 12, the leg 14 contacts the tabletop 12 on four sides.

According to an exemplary embodiment, the legs 14 may be quickly and easily disassembled from a generally planar material, or a generally rectangular frame, by simply loosening the thumbscrews 26 so that the legs 14 may be pulled from the planar material/frame. Advantageously, the leg assembly 11 allows a user to quickly and easily assemble a piece of furniture. In the event the user wishes to move the piece of furniture to another room, upstairs or downstairs, or transport the piece of furniture in a vehicle, the leg assembly 11 can be disassembled, so that the furniture is reduced to more manageable pieces. For example, when the legs of a table are removed from the tabletop, the tabletop may be more easily carried through a doorway, up/down stairs, or placed in a vehicle.

Referring still to FIGS. 2-3, according to an exemplary embodiment, each side of the body portion 16 of each leg 14 includes a relatively narrow elongated hole or aperture 36

(e.g., it may have a generally I-shaped configuration) disposed therethrough. While the holes 36 are shown as generally elongated, it should be understood that holes of other sizes, shapes, and/or configurations may be disposed within the legs 14. The pair of elongated holes 36 of each leg 14 are provided at substantially the same height relative to either end of the leg 14. As shown, the elongated holes 36 are disposed below the lower plate 20 and proximate thereto.

Referring now to FIG. 4, according to an exemplary embodiment, the elongated holes 36 are configured to receive an adjustable member or element in the form of a strap 15 (e.g., a strap such as a webbed or fabric strap that includes a member or element for tightening the strap, such as a ratchet or other device (hereinafter referred to as ratchet strap 15 for simplicity, although it should be understood that other types of adjustable members may be used, such as, for example, winch straps, cam-buckle straps, tie downs, cables, bungees, ropes, and other types of members now known or developed in the future that may provide bracing between different legs to provide added stability when assembled). For example, when a leg 14 is clamped onto the tabletop 12, a strap from the ratchet strap 15 may be routed from an inner side of the body portion 16, through one elongated hole 36, left/right to the other of the two elongated holes 36, and through the other of the two elongated holes 36 to the inner side of the body portion 16. Further, as shown in FIG. 4, a strap from a ratchet strap 15 may be routed in this manner for two legs 14 that are diagonally positioned on the table 10. According to other exemplary embodiments, Once the ratchet strap 15 is coupled to the elongated holes 36 of two legs 14 that are diagonally positioned on the tabletop 12, the ratchet strap 15 may be tightened in order to act as a bracing structure (e.g., a cross-brace, diagonal brace, X-brace, etc.) between the two legs 14. As shown in FIG. 4, this method of cross-bracing may be performed for both diagonal sets of legs 14. Thus, two ratchet straps 15 may be used to hold the legs 14 against the corners of the tabletop 12. That is, the ratchet straps 15 resist the movement of the legs 14 in an outward direction (e.g., a lateral direction) relative to the tabletop 12 by maintaining the strap and the associated legs in tension when in place. Advantageously, in the event that any clamp 34 becomes loose, the ratchet straps 15 will hold the legs 14 against the tabletop 12, thereby keeping the legs 14 and the tabletop 12 engaged and maintaining the structural integrity of the table 10.

According to an exemplary embodiment, the ratchet straps 15 shown in FIG. 4 provide additional stability to the table 10. For example, a load on the tabletop 12 may cause a moment in the legs 14 by which outwardly directed forces are exerted on the legs 14. Advantageously, the ratchet straps 15 shown in FIG. 4 may hold the legs 14 in compression, and the force exerted on the legs 14 by the ratchet straps 15 may overcome the outward forces that a load on the tabletop 12 exerts on the legs 14 such that the straps are in tension. Further, the ratchet straps 15 may overcome external outward forces caused by a user pulling the legs 14, or outward forces exerted by the floor against the legs 14. For example, in the event one wishes to slide the table 10 across a room, the ratchet straps 15 may overcome the outward forces exerted on the legs 14 by the user's arms and/or the floor.

Advantageously, a pair of ratchet straps 15 may be adjusted to accommodate a wide arrangement of tabletops. For example, the ratchet straps 15 may be shortened (tightened) in order to accommodate relatively narrow tables, or lengthened (loosened) in order to fit longer tables. Any excess strap of a ratchet strap 15 may be concealed by wrapping the excess around the ratchet strap 15, folding the excess strap over itself, or cutting the excess from the rest of the ratchet strap 15. Additionally, the configuration of the legs and straps as discussed herein according to various exemplary embodiments is relatively compact and lightweight (the extent to which depends, of course, on the material used to form the legs, among other factors), which allows for relatively easy portability of the leg assembly components.

According to another exemplary embodiment, a ratchet strap may be used as a cross-brace by routing the strap around the exterior surfaces of a diagonal pair of table legs. Although not shown in the FIGURES, according to this embodiment, a portion of the exterior surface of each table leg may be recessed such that a strap of a ratchet strap engages the recession. For example, when a ratchet strap is positioned within the recessed portion of the table leg, the strap may be flush with the rest of the table leg. Thus, when a strap is positioned within the recessed portions of two diagonal table legs, and the ratchet strap is tightened, the recessed portions may keep the straps from sliding down the table legs.

Although not shown in the FIGURES, according to another exemplary embodiment, a single ratchet strap may be routed around all four table legs of a table assembly. For example, a single strap may be coupled to each of the four legs, either crosswise such that an "X" is formed by the straps, or extending about the perimeter of the four legs. In another arrangement, the ratchet strap may be coupled to all four legs but may be positioned such that it does not extend about the perimeter, such as to leave one side open for seating (e.g., the strap may extend from a front left leg to a rear left leg to a rear right leg to a front right leg, and then back onto itself around such that the strap does not extend between the front left and right legs). According to another exemplary embodiment, the legs may not include apertures for receiving the straps, but the straps could simply be looped around the legs (to, for example, "lasso" each leg) or may be coupled in any desired manner to a feature provided on the leg (e.g., feeding the strap through a bolt, a hook, or other feature). The straps may be coupled or arranged in a variety of manners as will be appreciated by those reviewing the present disclosure, and such variations are intended to fall within the scope of the present disclosure.

According to other exemplary embodiments, other adjustable devices (e.g., adjustable elements, adjustable members, etc.) may be routed through holes disposed in the legs 14 in order to be used as cross-braces between diagonal pairs of legs. For example, a cable or rope may be routed through diagonal pairs of legs, the cable may be tightened, and a connector may be used to hold the cable against the legs. According to another exemplary embodiment, an elastic member (e.g., a tension spring, a rubber band, etc.) may couple diagonal pairs of legs.

Advantageously, a user may use the leg assembly 11 to quickly and easily build a custom-made piece of furniture. For example, a user may recondition and reuse any planar piece of material to build a unique piece of furniture. Further, the leg assembly 11 allows users to build a piece of furniture in a desired location for the piece of furniture. As a result, the challenges of carrying furniture through tight areas (e.g., doorways, stairs, etc.) may be eliminated. Additionally, as will be described in more detail below, disassembly of the leg assembly is quick and easy. Therefore, the leg assembly 11 makes furniture more portable. The ratchet straps 15 may be used to increase the stability and structural integrity of the furniture.

According to an exemplary embodiment, a method of assembling the leg 14 to a generally planar material or a rectangular element will now be described. First, legs are attached to the corners of the rectangular element and secured using a clamping device such as described herein. Diagonally-opposed legs (i.e., those positioned at diagonally opposite corners from each other) may then be structurally reinforced using an adjustable member such as a ratchet strap. According to one embodiment, the ratchet strap may extend through holes formed in each of the legs and then tightened to provide additional structural rigidity to the two legs so coupled. This process may then be repeated for the other pair of diagonally-opposed legs. Disassembly of the structure may then follow the steps in reverse.

Figure 5:
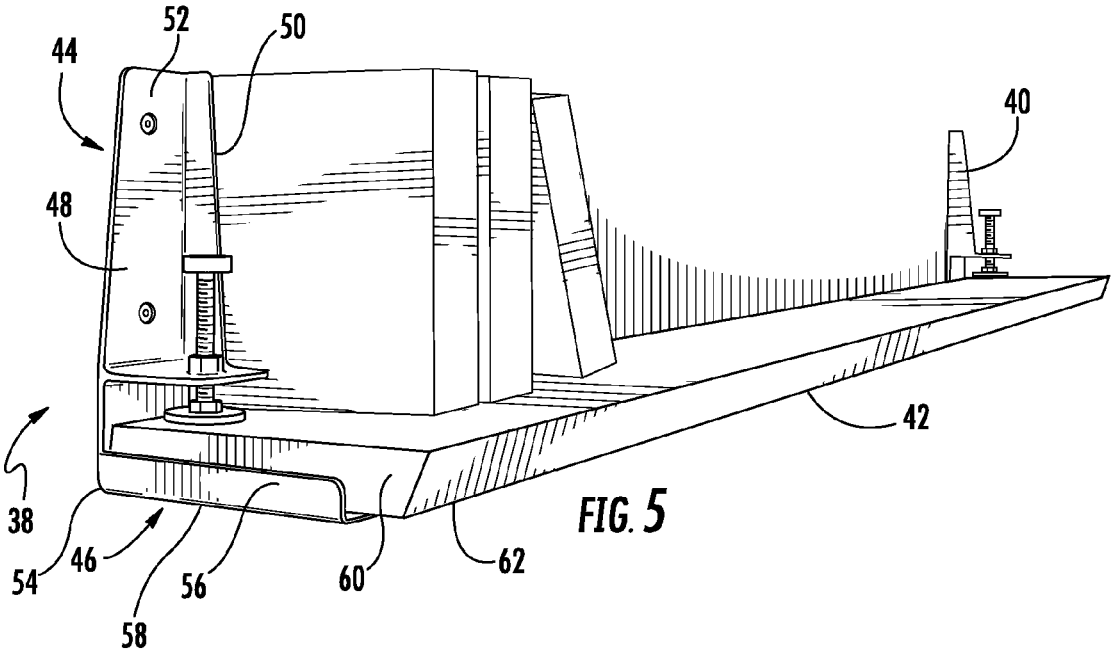
FIG. 5 illustrates a perspective view of a shelf according to an exemplary embodiment.
Figure 6:
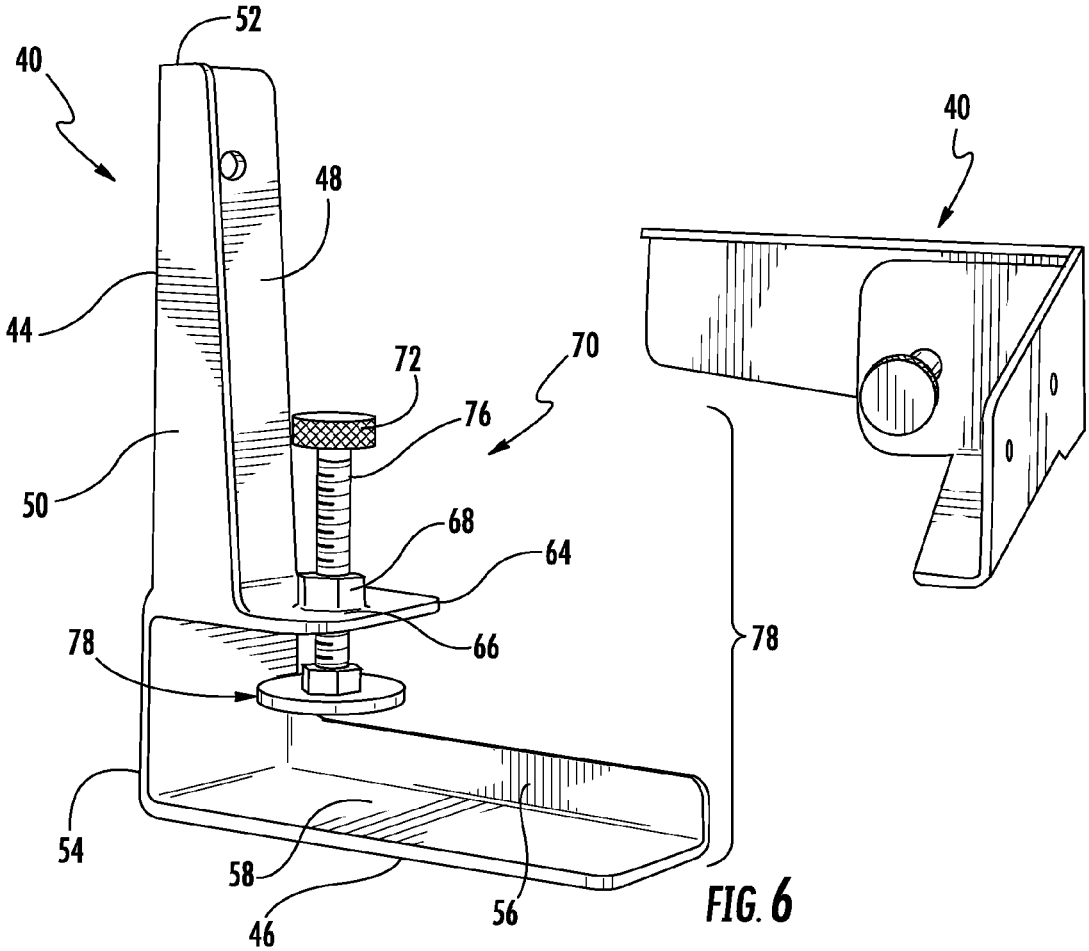
FIG. 6 illustrates a perspective view of two shelf ends used with the shelf shown in FIG. 5.

Referring now to FIGS. 5-6, an exemplary embodiment for a shelf assembly 38 is shown. The shelf assembly 38 includes a pair of shelf ends 40 (e.g., a left and right shelf end) and a middle shelf portion 42. Similar to the leg assembly 11 described above, the shelf ends 40 are configured to couple to almost any planar element. Thus, a user may build a unique shelf out of any desirable planar material. Although the middle shelf portion 42 is shown to be generally rectangular, according to other exemplary embodiments, a middle shelf portion may be triangular (e.g., for a corner shelf), or have any other suitable shape.

Referring to FIG. 5, each shelf end 40 includes a generally vertical portion 44 that is configured to be mounted to a vertical mounting surface, such as a wall, door, etc. In particular, the vertical portion 44 includes a rear side 48, which may include one or more holes or apertures, and fasteners may be used to couple the rear side 48 to a vertical mounting surface. The vertical portion 44 is also shown to include an inner side 50. Together, the rear side 48 and the inner side 50 define a "L"-shaped cross-section. Further, the vertical portions 44 of the left and right shelf ends 40 are mirror images of each other. That is, when the left and right shelf ends 40 are coupled to a mounting surface, the inner side 50 of the left shelf end is positioned on a right side thereof, and the inner side 50 of the right shelf end is positioned on a left side thereof. According to another exemplary embodiment, a vertical portion of a shelf end may have a "T"-shaped cross-section. For example, a rear wall of the vertical portion may extend on a left and right side of a middle wall, which extends outwardly away from the wall when the rear side is coupled thereto.

The vertical portion 44 of each shelf end 40 may further be defined by a first end 52 and a second end 54 opposite the first end. As shown in FIG. 5, the shelf ends 40 are mounted to a wall such that the first ends 52 are oriented upwards. The shelf ends 40 may also be mounted to a wall such that the second ends 54 are oriented upwards.

A horizontal portion 46 is shown as being coupled proximate the second end 54 of each shelf end 40. In particular, the horizontal portion 46 of each shelf end 40 is coupled to a portion of the rear side 48 that extends below the inner side 50. The horizontal portion 46 extends outwardly from the rear side 48 of the vertical portion 44.

Referring now to FIG. 6, according to an exemplary embodiment, the horizontal portion 46 of each shelf end 40 may comprise an end side 56 (e.g., an end, end wall, etc.) and a base side 58 (e.g., bottom wall, base, etc.). As shown in FIG. 6, the end side 56 and base side 58 define a "L"-shaped cross-section which is configured to engage the middle shelf portion 42. For example, the end side 56 of each shelf end 40 extends upwardly from the base side 58 toward the first end 52 of the vertical portion 44. Similar to the vertical portions 44 of each shelf end 40, the horizontal portions 46 shown in FIG. 6 are mirror images of each other. That is, when the left shelf end 40 is mounted to a wall, the end side 56 is positioned on a left side thereof, and when the right shelf end 40 is mounted to a wall, the end side 56 is positioned on a right side thereof. According to another exemplary embodiment, end sides 56 are not provided on the horizontal portion 46 of each shelf end 40.

According to an exemplary embodiment, the end and base sides 56, 58 of each shelf end 40 may be configured to engage the middle shelf portion 42. For example, referring again to FIG. 5, the end side 56 of each shelf end 40 may engage end surfaces 60 of the middle shelf portion 42, and a bottom surface 62 of the middle shelf portion 42 may rest on the base side 58.

According to an exemplary embodiment, each shelf end 40 may include generally planar element 64 (e.g., a support, wall, etc.) coupled to a bottom portion of the inner side 50. Thus, the element 64 of each shelf end 40 is provided above the base side 58 of the horizontal portion 46 (when the shelf ends 40 are mounted such that the first end 52 defines the top of thereof). The elements 64 of the shelf ends 40 are generally coplanar with the base sides 58. Further, according to an exemplary embodiment, the elements 64 may be formed by initially making a cut proximate an edge between the inner side 50 and the rear side 48 of the vertical portion 44. Then, the portion of the inner side 50 defined along the cut may be bent 90° to form the element 64, and the element 64 may be coupled to the rear side 48 by welding the edge therebetween.

According to an exemplary embodiment, a hole 66 is disposed within the element 64, and a threaded nut 68 is coupled to a top surface of the element 64. The threaded nut 68 is concentric with the hole 66. According to another exemplary embodiment, a threaded hole is disposed within the element 64.

According to an exemplary embodiment, a thumbscrew 70 is threadably coupled to the nut 68 (or to the threaded hole, as the case may be). The thumbscrew 70 comprises a knob 72 provided on a top end thereof, a flat member 74 provided on a bottom end thereof, and a threaded rod 76 provided between the knob 72 and the flat member 74. As shown in FIG. 6, the thumbscrew 70 is threadably coupled to the nut 68 such that the knob 72 is positioned above the element 64 and the flat member 74 is positioned within the space between the element 64 and the base side 58. Further, the flat member 74 is rotatable relative to the rod 76. Thus, the rod 76 is simultaneously rotatable relative to the nut 68 and the flat member 74. According to other exemplary embodiments, the flat member 74 is rotatably fixed relative to the rod 76.

The knob 72 may be rotatably fixed relative to the rod 76. Thus, the thumbscrew 70 may be threadably tightened or loosened by rotating the knob 72. As shown, the knob 72 is knurled so that a user may better grasp it. According to other exemplary embodiments, a knob may be configured in other ways to enable a user to better grasp it. For example, a knob may have a polygonal cross-section, or a special coating (e.g., a rubberized coating). Also, the circumference of the knob 72 is greater than that of the rod 76 so that a user can deliver greater torque to the rod 76. According to other exemplary embodiments, any suitable handle (e.g., a "T" handle) may be coupled to the top end of the rod 76.

Together, the thumbscrew 70, the element 64, the base side 58, and the section of the rear side 48 between the base side 58 and the element 64 form a clamp 78. The clamp 78 may be used to secure the middle shelf portion 42 to each shelf end 40. For example, a corner of the middle shelf portion 42 may be positioned between the base side 58 and the flat member 74 such that the middle shelf portion 42 engages the perpendicular vertical surfaces of the end side 56 and the rear side 48. Next, the thumbscrew 70 may be tightened until the flat member 74 engages a top surface of the middle shelf portion 42. Thus, when the flat member 74 engages the top surface of the middle shelf portion 42, the shelf end 40 bounds the middle shelf portion 42 on four sides.

According to an exemplary embodiment, when the left and right shelf ends 40 are secured to the middle shelf portion 42, such that the first end 52 defines the top of the shelf ends 40, the inner sides 50 may be used as bookends of the shelf assembly 38. That is, books and other objects may be supported on the middle shelf portion 42 and rest against either of the inner sides 50.

Although not shown in the FIGURES, according to another exemplary embodiment, the shelf assembly 38 may be mounted to a mounting surface such that the first end 52 defines the bottom of the shelf ends 40. According to this exemplary embodiment, the inner sides 50 of the shelf ends 40 would be positioned below the middle shelf portion 42, and thus would not be able to be used as bookends.

As utilized herein, the terms "approximately," "about," "substantially," "essentially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the table as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A leg assembly comprising:

four legs, each of the legs configured to couple to an outer edge of a generally planar member to form an assembly that has a surface supported by the four legs; and an adjustable strap coupled directly to and extending in a direct line between two of the four legs without contacting the planar member to form a bracing structure that provides enhanced structural rigidity for the assembly by resisting movement of the two legs away from each other while compressing the legs against the planar member;

wherein the adjustable strap extends at least partially around each of the two legs;

wherein each leg has a generally L-shaped cross-section that defines two perpendicular sides, and the cross-section of the legs is configured to engage a corner of the generally planar member; and wherein each side of the cross-section of each leg includes an elongated hole for receiving at least a portion of the adjustable strap, and wherein the adjustable strap extends through the elongated holes of the two legs to secure the two legs together.

2. The leg assembly of claim 1, wherein the adjustable strap is a ratchet strap.

3. The leg assembly of claim 1, wherein the adjustable strap extends between a pair of diagonally-opposed legs, and further comprising a second adjustable strap extending between a second pair of diagonally-opposed legs.

4. The leg assembly of claim 1, wherein each leg is clamped to the generally planar member.

5. The leg assembly of claim 1, wherein each leg comprises a thumbscrew configured to secure the leg to a generally planar member.

6. The leg assembly of claim 1, wherein each leg includes a clamping device for securing the leg to a generally planar member.

7. The leg assembly of claim 6, wherein at least a portion of the clamping device is integrally formed with the associated leg.

8. A table comprising:

a tabletop;

four legs coupled to the tabletop, each of the four legs including a clamping device for coupling the leg to an outer edge of the tabletop; and at least one adjustable strap extending in a direct line between and coupling a plurality of legs to each other, without contacting the tabletop, so as to both resist outward movement of the legs relative to the tabletop and to hold the legs against the outer edges of the tabletop so as to provide enhanced structural rigidity for the table;

wherein the adjustable strap is coupled directly to and extends at least partially around each of the plurality of legs;

wherein each leg has a generally L-shaped cross-section that defines two perpendicular sides, and the cross-section of the legs engages a corner of the tabletop; and wherein each side of the cross-section of each leg includes an elongated feature for receiving at least a portion of the adjustable strap, and wherein the adjustable strap extends through the elongated features of the plurality of legs to secure the plurality of legs together.

9. The table of claim 8, wherein the adjustable strap is a ratchet strap.

10. The table of claim 8, wherein each leg comprises at least one hole for receiving the adjustable strap to couple the adjustable strap to the leg.

11. The table of claim 8, wherein each leg comprises two holes for receiving the adjustable strap to couple the adjustable strap to the leg and has a generally L-shaped cross section.

12. The table of claim 8, wherein the adjustable strap extends between two legs that are diagonally opposed to each other.

13. The table of claim 8, wherein the clamping device comprises an upper plate and an adjustable member for engaging a surface of the tabletop to sandwich the tabletop between the upper plate and the adjustable member.

14. The table of claim 13, wherein the upper plate is integrally formed with the leg.

15. A method of coupling a plurality of legs to a tabletop, the method comprising:

positioning a first leg against a first corner of the tabletop;

positioning a second leg against a second corner of the tabletop, the second corner being diagonal to the first corner; and bracing the first and second legs to the first and second corners, respectively, using a first adjustable member coupled directly to and extending in a direct line between the first and second legs, wherein the first adjustable member holds the first leg against the first corner and the second leg against the second corner and also prevents the first leg and the second leg from moving away from each other;

wherein each of the first and second legs has a generally L-shaped cross-section that defines two perpendicular sides for engaging the first and second corners of the tabletop;

wherein each side of the cross-section of each leg includes an elongated feature for receiving at least a portion of the first adjustable member; and wherein bracing the first and second legs to the first and second corners includes routing the first adjustable member at least partially around and through the elongated feature of each of the first and second legs to secure the first and second legs together.

16. The method of claim 15, further comprising:

positioning a third leg against a third corner of the tabletop, the third corner being adjacent to the first and second corners;

positioning a fourth leg against a fourth corner of the rectangular element, the fourth corner being diagonal to the third corner; and bracing the third and fourth legs to the third and fourth corners, respectively, via a second adjustable member extending between the third and fourth legs.

17. The method of claim 16, wherein the first and second adjustable members are ratchet straps.

18. The method of claim 15, wherein each leg is clamped to the tabletop.

19. The method of claim 15, wherein a clamp comprising a thumbscrew is coupled to each leg.

20. The method of claim 15, wherein the first adjustable member acts as a cross-brace between the first and second legs.

* * * * *